United States Patent [19]

Eke

[11] Patent Number: 4,812,606

[45] Date of Patent: Mar. 14, 1989

[54] MICROWAVE OVENS FOR COOKING PRIMARILY MEAT ITEMS

[75] Inventor: Kenneth I. Eke, South Croydon, England

[73] Assignee: Microwave Ovens Limited, Shirley, England

[21] Appl. No.: 58,128

[22] Filed: Jun. 4, 1987

[30] Foreign Application Priority Data

Jun. 4, 1986 [GB] United Kingdom ..... 8613553

[51] Int. Cl.[4] ..... H05B 6/68

[52] U.S. Cl. ..... 219/10.55 B; 219/10.55 M; 99/325; 426/243

[58] Field of Search ..... 219/10.55 B, 10.55 M, 219/10.55 E, 10.55 R, 492; 99/325, 451, DIG. 14; 426/243, 523

[56] References Cited

U.S. PATENT DOCUMENTS

| | | | |
|---|---|---|---|
| 4,379,964 | 4/1983 | Kanazawa et al. | 219/10.55 B X |
| 4,481,394 | 11/1984 | Tanabe | 219/10.55 B |
| 4,488,026 | 12/1984 | Tanabe | 219/10.55 B |
| 4,499,357 | 2/1985 | Kojima | 219/10.55 B |
| 4,533,809 | 8/1985 | Eke | 219/10.55 M |
| 4,590,350 | 5/1986 | Ueda | 219/10.55 M X |
| 4,647,746 | 3/1987 | Eke | 219/10.55 B |

*Primary Examiner*—Philip H. Leung
*Attorney, Agent, or Firm*—Penrose Lucas Albright

[57] ABSTRACT

A microwave oven having a cavity for receiving a food item to be cooked, primarily meat items, a magnetron for delivering microwave power to the cavity, and a forced hot air system, including a fan and an electrical resistance heating element which are both disposed in a compartment separated from the cavity by a dividing panel. The oven has a first thermistor for monitoring air temperature drawn from the oven cavity after a predetermined time, between eight and fifteen minutes, dependent upon the nature of the food item to be cooked. When the predetermined time is reached, a microprocessor determines the remaining cooking time to complete cooking by referring to an internal program that relates to the particular food item to be cooked. A second thermistor monitors temperature near the heating element and, through the microprocessor, controls the heating element. The microprocessor thus determines a decreasing maximum air temperature curve over the remaining cooking time which is to be executed from the predetermined time to the end of cooking by referring to an internal program for sensed temperature control, again relating to the particular food item to be cooked.

15 Claims, 3 Drawing Sheets

MICROWAVE OVENS FOR COOKING PRIMARILY MEAT ITEMS

FIELD OF INVENTION

This invention relates to microwave ovens.

SUMMARY OF THE INVENTION

According to the invention a microwave oven has a food-receiving cavity, a magnetron for delivering microwave power to the cavity, a forced hot air system comprising an electrical resistance heating element and a fan operative to blow air over the heating element and thence through the cavity simultaneously with the production of microwave power, temperature sensing means for sensing the temperature of the hot air flow and timing means for timing cooking from the commencement of cooking with the cavity in a cold condition, and control means for controlling the operation of the magnetron and the hot air system and operative to:

1. sense the temperature at a predetermined time after commencement of cooking, 2. determine the further cooking time beyond the predetermined time in accordance with a predetermined characteristic relating sensed temperature at the predetermined time to the further cooking time, 3. cease production of microwave power and hot air power after the further cooking time has elapsed to terminate cooking.

The predetermined time is preferably between about eight and fifteen minutes, conveniently about ten minutes. The further cooking time which is added after the predetermined time may be anything from zero to up to about sixty-five minutes, the characteristic relating the sensed temperature at the predetermined time to the further cooking time being determined empirically and conveniently being represented as a polynomial equation preloaded in the control means.

The temperature sensing means preferably comprises a thermistor located adjacent the fan, and the microwave oven may have a time display which, when the predetermined time is reached, displays the further cooking time and counts down to zero as the further cooking time elapses, reaching zero when cooking is complete.

The invention was devised primarily to cook meat items. It will be appreciated that for larger cuts of meat the further cooking time can take the total cooking time to well beyond thirty minutes. For these longer cooking times, it is desirable that the foodstuff should not be exposed to high temperatures for a prolonged period of time because this tends to cause the foodstuff to dry out. To avoid this problem, the temperature sensed at the predetermined time may govern themostatic control of the hot air system, so that the maximum hot air temperature reached during the further cooking time decreases as the further cooking time increases. Preferably, a second thermistor is used to monitor the hot air temperature immediately downstream of the electrical resistance heating element, and the temperature sensed by the second thermistor is used in a thermostatic control circuit which selectively energizes the de-energizes the electrical resistance heating element during the further cooking time to prevent the hot air temperature reaching undesirably high levels.

The invention will now be described by way of example with reference to the accompanying drawings, in which:

DESCRIPTION OF THE PREFERRED EMBODIMENT

Figure 1:
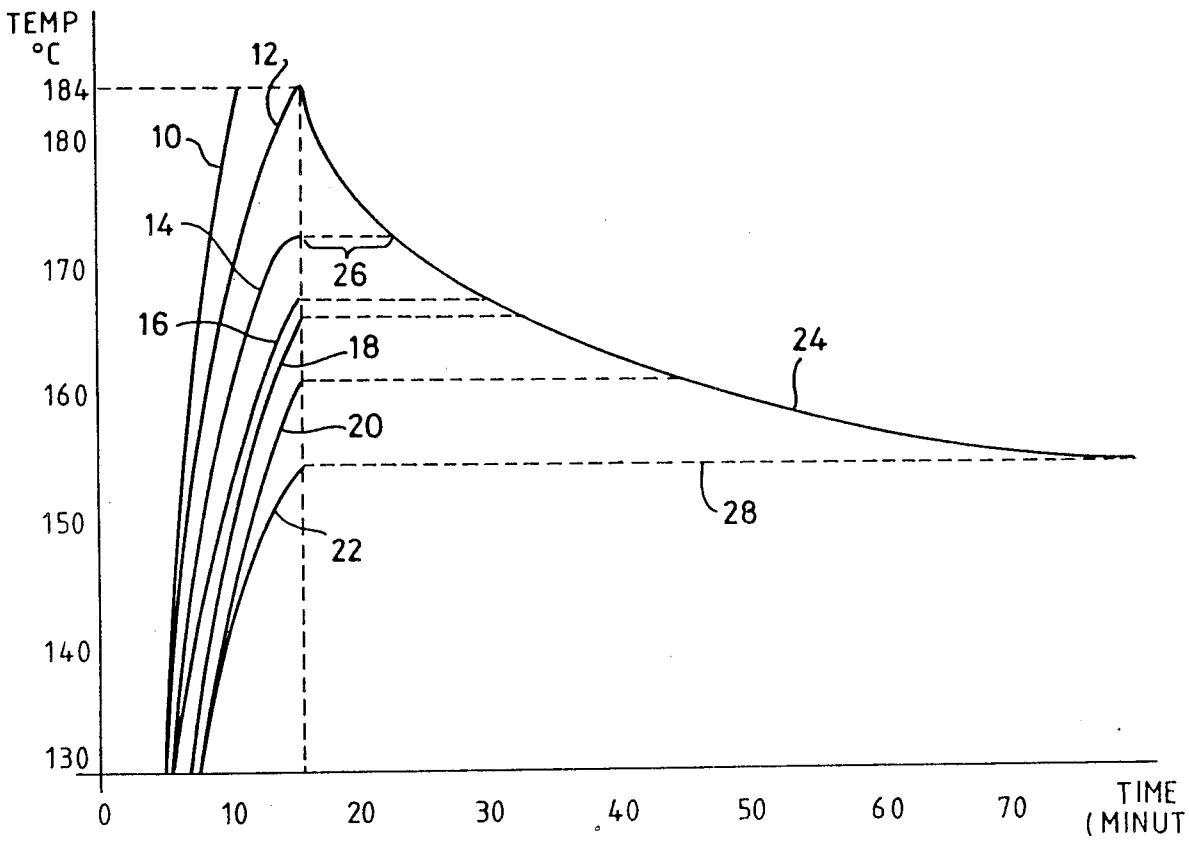
FIG. 1 is a composite temperature/time graph showing below fifteen minutes on the time axis the variation of hot air temperature with time and after fifteen minutes shows the characteristic relating sensed temperature at fifteen minutes to the further cooking time, when cooking poultry items a, FIGS. 2 and 3 are similar graphs for cooking beef and pork items, respectively.

The microwave oven forming the preferred embodiment of this invention is similar in construction to the microwave oven disclosed in the applicant's UK specification No. 2127658 and European patent specification No. 0099705. These are equivalent of U.S. Pat. No. 4,508,947. In particular, the oven comprises a food-receiving cavity, a magnetron 15 for supplying microwave power to the cavity 11 and a forced hot air system for forcing a supply of hot air through the cavity 11 simultaneously with the delivery of microwave power. The forced hot air system comprises an electrical resistance heating element 17 and a fan 19, both of which are accommodated in a compartment 13 disposed behind a rear panel 21 of the cavity 11. Inlet apertures 25 and outlet apertures 27 into and from compartment 13 in the rear panel 21 enable a flow of air to be forced by the fan over the electrical resistance heating element and thence through the cavity 11.

FIG. 1 constitutes between zero and fifteen minutes a family of curves showing the variation of hot air temperature with time for poultry items of differing size. Curve 10 shows the temperature/time variation for a small chicken drumstick which is cooked at about eleven minutes when the sensed temperature reaches the maximum of 184° C. Curve 12 shows the temperature/time variation for a small chicken quarter, the sensed temperature reaching 184° C. at time fifteen minutes. Curves 14, 16, 18, 20 and 22 show temperature/time variations for various sizes of fowl such as a a two pound chicken (14), a three pound chicken (16), and a twelve pound turkey (22). It will be noted that for these items the sensed temperature at fifteen minutes varies between about 153° C. and 172° C.

After fifteen minutes, FIG. 1 shows a curve 24 representing the variation of sensed temperature at fifteen minutes with the further cooking time required beyond fifteen minutes. For example, for the two pound chicken of curve 14, the curve of characteristic 24 shows that the further cooking time required is represented at 26, which is about seven minutes. Hence, the total cooking time for the two pound chicken is fifteen minutes plus seven minutes, making a total of twenty-two minutes. For the small chicken quarter of curve 12 no further cooking time is required so that this particular food item is cooked at the predetermined time of fifteen minutes.

It will be seen that for the largest item, the twelve pound turkey, the further cooking time required is about sixty-five minutes, represented by time 28 in FIG. 1.

The hot air temperature sensed up to the predetermined time of fifteen minutes is detected by a thermistor 29 placed adjacent to the fan 19.

For larger food items which require a total cooking time of more than about thirty minutes, it is desirable to limit the maximum hot air temperature to prevent drying out. This is conveniently achieved by using the temperature sensed at fifteen minutes to in conjunction with a second thermistor 31 in a thermostatic control circuit. The second thermistor 31 is located immediately downstream of the electrical resistance heating element 17. For example, if the temperature at fifteen minutes is below 155° C., as for curve 22, the thermostatic control is set to limit the hot air temperature in the further cooking time to 180° C. If the temperature at fifteen minutes is between 155° C. and 163° C., the thermostatic control limits the hot air temperature to 190° C. If the temperature at fifteen minutes is above 163° or 165°, no thermostatic control is applied. The thermostatic control acts to energize or de-energize the electrical resistance heating element to keep the hot air temperature at or closely below the determined level. It will therefore be appreciated that the temperature sensed at the predetermined time of fifteen minutes not only determines the length of the further cooking time, but also sets the maximum hot air temperature so as to prevent larger food items drying out.

When the further cooking time has elapsed the control means of the oven which comprises, for example, microprocessor 35, turn off the magnetron and the hot air system which completes the cooking process.

Figure 2:
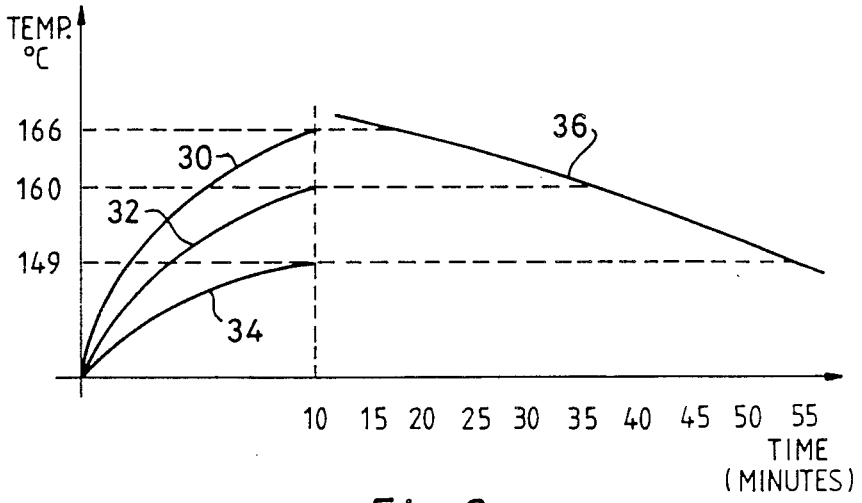

FIG. 2 is a composite graph similar to FIG. 1, but for beef items. In this case the predetermined time is ten minutes and it is the magnitude of the temperature sensed at ten minutes which determines the further cooking time and any thermostatic control for the larger meat items. Curve 30 shows the temperature/-time variation for a fourteen ounce piece of beef, and curves 32 and 34 show similar temperature/time variations for pieces of beef of two pounds four ounce weight, and four pounds eight ounce weight, respectively. Curve 36 shows the extent of further cooking time required as a function of the temperature sensed at ten minutes. Hence, the piece of beef following curve 30 requires five minutes of further cooking time, making fifteen minutes in all. The piece of beef following curve 32 requires a further cooking time of twenty-six minutes and the piece of beef following curve 34 requires forty-five minutes further cooking time. As before, the temperature sensed at the predetermined time (in this case ten minutes) is used to limit the maximum temperature of the hot air by thermostatic control.

If the user requires a rare or well done result the curve 36 is effectively shifted up or down so as to reduce or increase the further cooking time.

Figure 3:
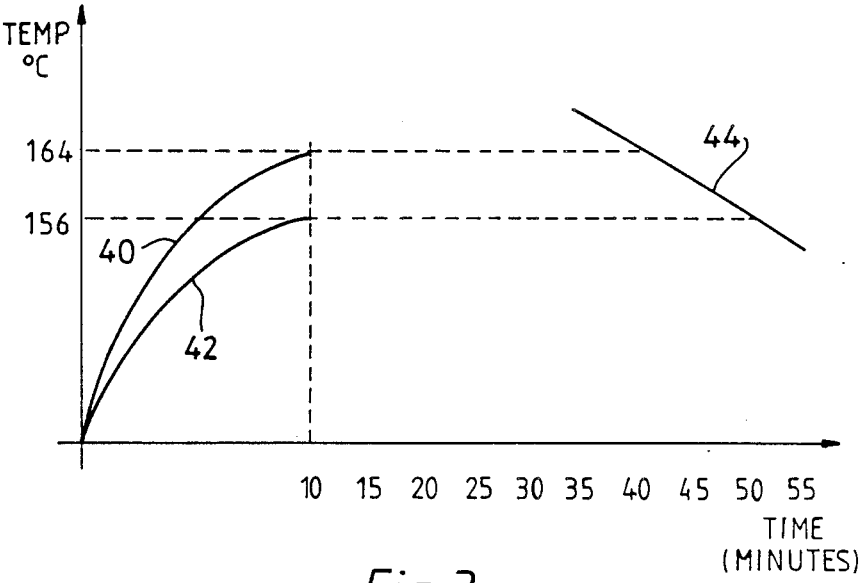
Figure 4:
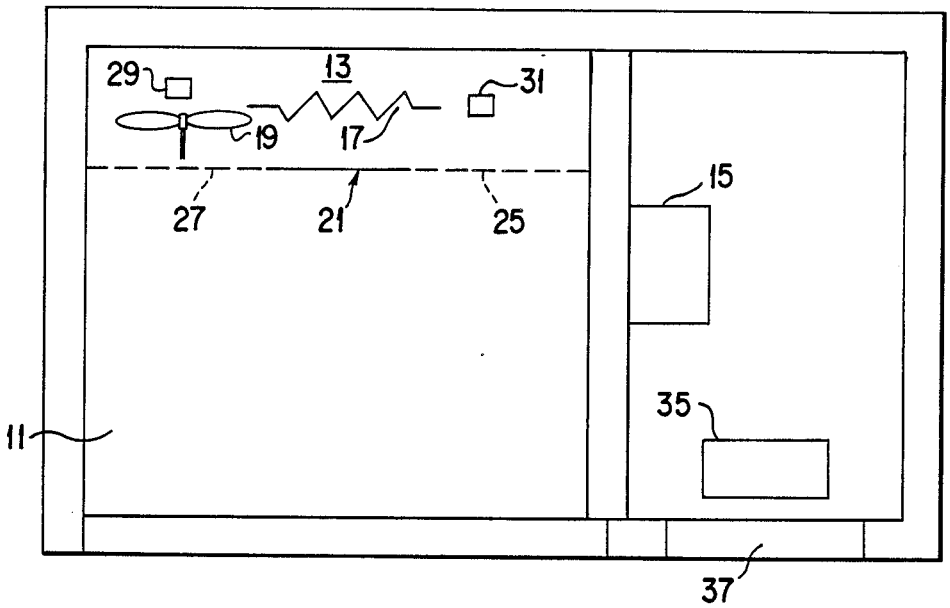
FIG. 4 is a diagrammatic plan view of the oven.

FIG. 3 shows between zero and ten minutes the temperature/time variation for two differing sizes of pork joint. Curve 40 shows the temperature/time variation for a two pound pork joint and curve 42 shows the temperature/time variation for a pork joint weighing three pounds six ounces. As for beef, the hot air temperature is sensed at the predetermined time of ten minutes, and the magnitude of this temperature governs the magnitude of the further cooking time, in accordance with the characteristic 44 relating sensed temperature to further cooking time. FIG. 3 shows that the pork item following curve 40 requires a further cooking time of twenty-eight minutes and that the pork item following curve 42 requires a further cooking time of forty-two minutes.

It will be understood by those skilled in the art that curves 24, 36 and 42 reflect the further cooking time intervals for poultry, beef and pork respectively. These curves were determined empirically and can be represented by polynomial equations which are used in the oven's control means to govern the corresponding further cooking time intervals dependent on oven air temperatures reached at the end of the corresponding predetermined times, fifteen minutes for poultry and ten minutes for beef and pork.

In all cases once the predetermined time has been reached the oven displays the required further cooking time on a digital display 37 which counts down to zero as the further cooking time elapses, reaching zero at the end of the further cooking time, so that the user has an indication of when cooking will be completed. Also, in all cases the microwave and hot air power levels are maintained constant throughout at 1100 watts hot air power and 200 watts microwave power into the cavity.

The oven described is preferably semi-automatic in operation, in that the user touches one of a plurality of pads, for example, marked "Red Meats", "Poultry", "Baked", depending on the food item being cooked. If the user selects "Red Meat", the oven senses the temperature at the predetermined time of ten minutes, and if the user selects "Poultry", the predetermined time is fifteen minutes. However, the predetermined times may be pre-programmed by the oven manufacturer to other values, and may be the same for all meats, depending on power levels.

Having disclosed my invention what I claim as new and to be secured by Letters Patent of the United States is:

1. A microwave oven which comprises:

a food-receiving cavity; a magnetron for delivering microwave power to said cavity; a forced hot air system including an electrical resistance heating element and thence through said cavity simultaneously with the production of microwave power; a first means for sensing the temperature of the air flow exiting said cavity; a timing means for timing cooking from the commencement of cooking with said cavity in a cold condition; control meant for controlling the operation of said magnetron and said forced air system; said control means operative to (1) sense the temperature in said cavity at a predetermined time after commencement of cooking, (2) determine the further cooking time interval beyond said predetermined time in accordance with a predetermined characteristic relating sensed temperature at said predetermined time to the requisite further cooking time, and (3) cease production of microwave power and power to said heating element after the further cooking time interval has elapsed to terminate cooking; said predetermined characteristic relating said sensed temperature at said predetermined time to said further cooking time interval having been determined empirically and having been preloaded into said control means; said temperature sensed at said predetermined time governing the thermostatic control of said forced hot air system so that the maximum air temperature during said further cooking time interval decreases as said further cooking time interval increases; and a second temperature sensing means comprising a thermistor located to monitor air temperature immediately downstream of said heating element during said further cooking time interval to prevent the hot air temperature from reaching undesirable high levels.

2. A microwave oven according to claim 1 wherein said predetermined time is between eight and fifteen minutes.

3. A microwave oven according to claim 2 wherein said predetermined time is substantially ten minutes.

4. A microwave oven according to claim 1, wherein said first mentioned temperature sensing means further comprises a thermistor which is located adjacent said fan.

5. A microwave oven according to claim 1 wherein said oven comprises a timed display which, when said predetermined time is reached, displays said further cooking time interval and counts from commencement of said further cooking time interval backwards to zero as said further cooking time elapses, reaching zero when cooking is complete.

6. A microwave oven according to claim 1 wherein said control means comprises a microprocessor.

7. A microwave oven and controls for cooking meat items which comprise: a food-receiving cavity; a magnetron for delivering microwave power to said cavity; a forced hot air system including an electrical resistance heating element and a fan operative to blow air over said heating element and thence through said cavity simultaneously with the production of microwave power; temperature sensing means for sensing the temperature of air flow exiting said cavity; timing means for timing cooking from the commencement of cooking with said cavity in a cold condition; control means for controlling the operation of said magnetron and said forced air system; said control means cooperating with said temperature sensing means and said timing means for performing the functions of (1) sensing the temperature in said cavity at the end of a predetermined period of time after commencement of cooking, (2) determining based on said sensed temperature a further cooking time interval beyond said predetermined period of time wherein the length of said time interval is an inverse function of said sensed temperature at the end of said predetermined period of time which is sufficient to complete cooking of the specific meat item in said cavity, and (3) stopping said microwave power and power to said heating element after the further cooking time interval has elapsed to terminate cooking of the meat item in said cavity; further temperature sensing means that senses air temperature immediately downstream of said heating element during said further cooking time interval, and thermostatic control means associated with said further temperature sensing means to prevent the air temperature in said cavity during said further cooking time interval from reaching levels which will cause the meat item in said cavity to be dried undesirably during said further cooking time interval.

8. A microwave oven and controls according to claim 7, wherein said predetermined period of time is between about eight and fifteen minutes.

9. A microwave oven and controls according to claim 8, wherein said predetermined period of time is about ten minutes.

10. A microwave oven and controls according to claim 7, wherein said first mentioned temperature sensing means comprises a thermistor located adjacent said fan.

11. A microwave oven and controls according to claim 7, wherein said oven comprises a timed display at the end of said predetermined period of time of said further cooking time interval which counts from the commencement of said further cooking time interval the amount of time remaining until the end of said further cooking time interval as said further cooking time interval elapses, reaching zero when the cooking of said meat item is complete.

12. A microwave oven and controls according to claim 7, wherein said control means comprises a microprocessor.

13. A microwave oven and controls according to claim 7, wherein said thermostatic control means is actuated only for meat items requiring a total cooking time of more than about thirty minutes.

14. A microwave oven and controls according to claim 13, wherein said thermostatic control means which controls the maximum air temperature in said cavity controls that maximum temperature at a temperature which is an inverse function of the length of said further cooking time interval whereby for longer total lengths of further cooking time intervals the corresponding maximum air temmperatures in said cavities are less.

15. A microwave oven and controls according to claim 7, wherein desirable further cooking time intervals following said predetermined period of time have been determined empirically and fitted into a polynomial equation which is preloaded in said control means for governing said further cooking intervals.

* * * * *